US009834966B2

(12) United States Patent
Alfredsson et al.

(10) Patent No.: US 9,834,966 B2
(45) Date of Patent: Dec. 5, 2017

(54) DISASSEMBLABLE HINGE WITH A SAFETY CATCH

(71) Applicant: Industrilås i Nässjö AB, Nässjö (SE)

(72) Inventors: Bengt-Åke Alfredsson, Bodafors (SE); Adam Linnåsen, Tenhult (SE)

(73) Assignee: Industrilås Nässjö AB, Nässjö (SE)

( * ) Notice: Subject to any disclaimer, the term of this patent is extended or adjusted under 35 U.S.C. 154(b) by 287 days.

(21) Appl. No.: 14/443,472

(22) PCT Filed: Nov. 26, 2012

(86) PCT No.: PCT/EP2012/073588

§ 371 (c)(1),
(2) Date: May 18, 2015

(87) PCT Pub. No.: WO2014/079512

PCT Pub. Date: May 30, 2014

(65) Prior Publication Data

US 2015/0292249 A1 Oct. 15, 2015

(51) Int. Cl.
*E05D 7/10* (2006.01)
*E05D 7/12* (2006.01)
(Continued)

(52) U.S. Cl.
CPC ..... *E05D 7/1061* (2013.01); *E05B 65/48* (2013.01); *E05D 3/02* (2013.01); *E05D 7/02* (2013.01);
(Continued)

(58) Field of Classification Search
CPC ..... E05B 65/48; E05D 7/1061; E05D 3/02; E05D 7/02; E05D 15/505; E05D 7/10; E05D 7/12
(Continued)

(56) References Cited

U.S. PATENT DOCUMENTS 8,667,818 B1 * 3/2014 Mchatet ..... A47F 5/0861 211/4
2007/0039973 A1 * 2/2007 Boenig ..... A45C 13/005 220/847
2016/0356067 A1 * 12/2016 James ..... E05D 11/1014

FOREIGN PATENT DOCUMENTS

DE 2343583 3/1975
DE 3511027 10/1986
DE 3626512 2/1988

* cited by examiner

*Primary Examiner* — Suzanne Barrett
(74) *Attorney, Agent, or Firm* — Vidas, Arrett & Steinkraus, P.A.

(57) ABSTRACT

The invention relates to a disassemblable hinge (1) having a latching member (2), adapted to be associated with an openable door (20), and a hinge member (3), adapted to be associated with a corresponding door frame (21). The latching member (2) comprises a main body (4) and a catch (5), wherein said main body (4) comprises a hinge slot (6) adapted to receive said hinge member (3), wherein said catch (5) is rotatably engageable with said hinge member (3) around a first axis (A1). The catch (5) is movable between a closed state and an open state, and into a disengaged state. The catch (5) and said hinge slot (6) defines a space (14) for housing said hinge member, wherein said catch (5), in its closed state, locks said hinge member (3) in said space (14). The space (14) is expanded when said catch (5) is moved from said closed state to said disengaged state. The catch (5) is moved from said disengaged state to said open state by rotating said catch (5) around a second axis (A2), thereby releasing said hinge member (3) from said space (14). Thereby a disassemblable hinge is provided enabling a secure opening operation in a two step maneuver.

16 Claims, 8 Drawing Sheets

(51) Int. Cl.

| | |
|---|---|
| ***E05D 15/50*** | (2006.01) |
| ***E05B 65/48*** | (2006.01) |
| ***E05D 3/02*** | (2006.01) |
| ***E05D 7/02*** | (2006.01) |

(52) U.S. Cl.
CPC ..... *E05D 7/10* (2013.01); *E05D 7/12* (2013.01); *E05D 15/505* (2013.01)

(58) Field of Classification Search
USPC ..... 70/14
See application file for complete search history.

DISASSEMBLABLE HINGE WITH A SAFETY CATCH

TECHNICAL FIELD

The present relation relates to a door hinge, and more particularly to a disassemblable hinging device with a latching function.

BACKGROUND

In the field of cabinet doors and hatches, there is usually a closing device like a latch. The latch may be of various complexities, from a swivel latch or a hasp to more complex latches. Regular doors on cabinets are generally mounted in conventional ways, having a hinged side and a latch and handle on the other side. However, in many industrial applications, there may be a need to be able to open the door from either side. This may be due to space limitations or the need for ability to reach the content of the cabinet from different angles, or alternatively removing the door completely for a maintenance action. An example of usage areas for such hatches may be electrical enclosures, or hatches in ventilation ducts for use by maintenance staff and engineers.

A known way of solving the above problem is to use a disassemblable hinge as disclosed in WO2006/136939. A pair of disassemblable hinges may be mounted on two or more sides of the cabinet door at the same time, and function as both a hinge and a latch. It may contain a fixed part to be mounted on a door frame, and a movable part to be mounted on the door. The fixed part has a hinge pin, and the movable part has a handle that operates a pair of claws that closes around the hinge pin and is fixed in that state when the handle is closed, allowing the hinge to swing when the claws are closed, and open as a hatch when the claws are released. When assembled on both sides, the door is shut, but when releasing the hinge on one side, the other hinge may enable the door to swing in the opposite direction.

The problem with such a solution is that it may only be safe to use on certain types of doors and hatches. For instance, if the hatch would be mounted in a ceiling, there would be a risk that the hatch abruptly swings down on the person opening it. Another example may be that the hatch to be open may contain any pressurized media behind it. If to be used on a pressurized hatch, the hatch may, when releasing the hinge, swing open with a large force from the pressure, risking injuring the person opening the hatch.

It is therefore a need to provide a more secure disassemblable hinge.

SUMMARY

It is an object of the present invention to provide an improved solution that alleviates the mentioned drawbacks with present devices. Furthermore, it is an object to provide a disassemblable hinge having a latching member, adapted to be associated with an openable door, and a hinge member, adapted to be associated with a corresponding door frame. The latching member comprises a main body and a catch, and the main body has a hinge slot adapted to receive the hinge member, wherein the catch is rotatably engageable with the hinge member around a first axis. The catch is movable between a closed state and an open state. The catch is further movable into a disengaged state, wherein the catch and the hinge slot, defines a space for housing the hinge member. The catch, in its closed state, locks the hinge member in the space, wherein the space is expanded when the catch is moved from the closed state into the disengaged state, wherein the catch is moved from the disengaged state to the open state by rotating the catch around the second axis, thereby releasing the hinge member from the space.

With a hinge that can be disassembled by having a catch that may be disengaged and removed from the hinge member in more than one step, a safer opening of the hinge may be provided. For instance, for a disassemblable hinge that may be used on a pressurized hatch, the hinge may be opened with a two-step-manoeuvre, where the hinge may provide an air tight closure for the hatch when closed. For example, the catch may apply pressure onto the hinge member that ensures a tight compression of the hatch when the catch is in its dosed state. The hinge member may be located in a hinge slot, incorporated in the latching member, adapted to enable a rotational movement for the hinge member. The hinge slot and the catch may limit the hinge member in a space, so the hinge member does not escape from its location, and thereby may be locked in its location. When opening the pressurized hatch, maintenance staff may have the liberty to decide from which side to open the hatch, since the disassemblable hinge may be provided at two or more sides of the hatch. During the opening operation, maintenance staff may operate the catch to move into a disengaged state, wherein the space is slightly expanded, but still trapping the hinge member in a limited space. The hinge member may thus still be locked by the catch with a slightly loser grip, allowing the hatch to open slightly and the pressure behind the hatch to escape without risking the hatch to fling open on the maintenance staff, and let the pressure equalize before the hinge may be completely loosened and the catch, by being rotated, releases the hinge member, allowing the hatch to open. The hinge may thus provide a choice of whether to open the hatch on one side, or even remove the hatch completely during maintenance, since the hinge on either side may be removable. The hatch may be closed again by first placing the hinge slot over the hinge member, perform a reverse two-step-operation by turning the catch back into its disengaged state when the hatch is slightly open, and subsequently cause the catch to compress against the hinge member, narrowing the space, to its closed state in order to fully close the hatch.

According to one embodiment, the catch may be moved from the closed state to the disengaged state by moving the catch away from the hinge member axially along a second axis.

The catch may be movable in order to expand the space and thus disengage the hinge member. The direction of the movement of the catch may stretch along an axis which may be perpendicular to the hinge slot, in order to increase the space volume between the hinge member and the catch. The space may be expanded enough in order to disengage the hinge member, but still be narrow enough for the hinge member to be locked by the catch in the space.

According to one embodiment, the second axis may be perpendicular to the first axis. The second axis of movement may be perpendicular to the first rotational axis which may coincide with the hinge member, since it may provide a more even and symmetric effect from any forces that may arise from the disengaged, partially open hatch.

According to one embodiment, the catch may comprise a shaft and a pawl, wherein the shaft extends axially along the second axis, wherein the pawl may be perpendicular to the shaft. In order to facilitate any operation of the pawl, it may further comprise a shaft. Also, the catch may comprise a pawl that may be arranged so that the extremity of the pawl extends perpendicularly relative to the shaft. The shaft may be arranged so that the pawl may be operated in a simple manner. The shaft may be operated manually via a handle or possibly automatically via a motor.

According to another embodiment, the hinge member may comprise a hinge pin, adapted to be received in the hinge slot. The hinge member may be adapted to facilitate any hinging effect by being provided with a hinge pin. The hinge pin may be arranged between two symmetric holders. By having a hinge pin that is placed between two holders, the middle section may be arranged to be placed in the hinge slot, when the hinge is to be closed. The hinge member may further be provided with a number of mounting holes in order to enable attachment to for instance a door frame. The hinge pin may alternatively be arranged to be supported by another holder arrangement. For example, the hinge pin may be arranged with only one holder at a suitable place along the hinge pin.

According to another embodiment, the latching member further comprises a handle which may be pivotal relative to the main body, wherein the catch may be connected to the handle. By providing a handle, the catch may be operated more sufficiently and accurately. The handle may be directly or indirectly connected to the catch, and may provide a torque to allow the catch to rotate. It is possible that the handle may be incorporated in the catch or act as an extension of the catch. The handle may be an elongated shaft, a circular handle or a T-handle or another type of handle, such as a knob. The handle may be pivotal in relation to the main body in order to provide motion in several required directions. This may be achieved by allowing rotation by the handle around more than one axis, for instance two intersecting axes. Since the handle may operate the catch for any of its movements, the handle may need to be able to perform corresponding movements.

According to yet another embodiment, the handle may be rotatably connected to the catch via a third axis. The catch may be operated by the handle, and in order to allow for the catch's movement in an axial direction along the second axis, this movement may be enabled by a rotation of the handle. The connection between the handle and the catch may thus be via a third rotation axis. The second axis may intersect the third axis to provide a pivot effect to allow the handle to rotate around several axes.

According to another embodiment, the handle may be adapted to produce a momentum around a momentum axis when the handle is moved between a folded down position and a raised position, which causes the catch to move axially along the second axis.

The handle may be adapted to be able to provide axial movement of the pawl. In order to transfer any movement by the handle, that may be rotational, to the catch, which movement is axial, the handle may transfer an eccentric movement. The handle that may be connected to the catch via a hinged joint may thus by its folding down movement cause the catch to move in an axial direction opposite to the handle's direction of movement. This may be enabled by allowing the handle to produce a momentum, and allowing the counter force to act upon the catch. The momentum may be produced by letting the handle, as it is folded down towards the main body, rest on a support and thereby cause leverage on the catch. The location of the support may define the momentum axis. The support may be incorporated in the handle, or alternatively in the main body.

According to another embodiment, the momentum axis may be located at a distance from the second axis. In order to produce a momentum on the pawl, the leverage support and the second axis may be located at a distance from each other. The distance may vary depending of the size of the force required to dose and open the hinge.

According to another embodiment, the momentum may be defined by a seat that causes the handle to act as a lever arm on the catch. The latching member may be provided with a seat. The seat may be defined by an altering shape on the handle, such as a chamfer, notch or a radius, so when the handle is being moved, the chamfer, notch or radius pulls down over the main body, and the handle forces the pawl, by the created momentum, to move along the second axis. The handle may thus have an edge, that may be slightly angled as a chamfer towards the second axis, so when the handle is pulled, the transition between the angled edge and the straight edge, as it contact a flat surface of the main body, may cause a momentum. The seat may alternatively be shaped like a pin or an extrusion that extrudes from the main body. The seat may be designed so that the handle, that may have corresponding supports, may be lowered over the seat. When moving the handle between a raised position and a folded down position, a momentum may be produced around the seat and thereby a counter force develops on the opposite side of the seat, which may cause the catch to move in an opposite direction. The seat thus defines a momentum axis. The linear movement of the catch may be possible due to the rotational connection between the catch and the handle.

According to one embodiment, the handle is rotatable around a fifth axis, whereby the catch may be moved between the disengaged state and the open state when the handle is rotated. When the handle is in its raised position, it may be rotated around said fifth axis, thereby moving the catch between the disengaged state and the open state. The handle may be directly connected to the catch, causing the movement of the catch. It is also possible that the movement of the handle may be transferred via another rotational transfer means. As an example, the turning of the handle may occur at a distance from the second axis, requiring intermediate rotational transfer arrangements, like a cog wheel. Also, this may be needed if the handle's rotation and the catch's rotation are not parallel.

According to one embodiment, the fifth axis may coincide with the second axis (A2). The second axis and the fifth axis may coincide if the distance allows for that. Also, by arranging the second axis and the fifth axis to coincide, any intermediate arrangements for rotational transfer may be avoided, which may provide for a more stable arrangement since any additional parts may increase the risk of failure of the hinge or require an increasing amount of service and maintenance.

According to one embodiment, the latching member comprises a lock, arranged to prevent the catch to move from its closed position to its disengaged position. By providing the disassemblable hinge with a lock, any unwanted and accidental opening of the hinge may be avoided. The lock may be placed so that any unintentional movement of the catch may be prevented. For instance, the lock may be placed in the handle to engage with a corresponding part on the main body, or alternatively the lock may be placed on the main body adapted to engage with a corresponding part on the handle. The lock may be operated manually by twisting, pressing, sliding, pushing or pulling a device that may allow the lock to release.

According to one embodiment, the lock may be arranged on the handle in order to prevent the handle to lift from its folded down position. Since the disassemblable hinge may be equipped with a handle to operate the pawl, the lock may be located near the handle to facilitate any operations by opening the hinge since.

According to one embodiment, the lock may be a keyed lock. Due to access limitations, the opening of the hinge may only be privileged to some selected people. For instance, if the hinge is mounted on an electric cabinet, the cabinet may only be opened by authorised electricians, and thus, only those staff may be equipped with a key to operate the disassemblable hinge. Also, the keyed lock may be another safety precaution in order to avoid accidental or unauthorised opening of the hinge.

According to one embodiment, the latching member further comprises a spring member, arranged to act with a spring force upon the catch. The latching member may be provided with a spring member. The spring member may be arranged close the shaft of the catch and may be adapted to act with a force on the catch. The spring may be tensioned when the catch is put in its closed state, and the spring member thus being compressed between the pawl and the main body. Because of the spring force acting to push the catch away from the hinge member, the spring force may help the catch to move into the disengaged state, when such movement is intended, for instance when the latch is released. This enables a manual opening action of the hatch that may require less hand force by a person. Also, since the spring member may be adapted to provide a certain tension to the catch when it is put in its closed state, the spring force may be helpful for stabilising the latch in a closed state, since it may then prevent the catch from rattling.

According to one embodiment, the spring member may be arranged adjacent to the shaft, wherein the spring member may be compressed when the catch is in a closed state. By placing the spring member adjacent to the shaft, the movement of the pawl may directly affect the spring member.

According to one embodiment, the spring member may be a coil spring. The spring member may be a coil spring, arranged around the catch shaft for immediate response of the catch by the coil spring.

BRIEF DESCRIPTION OF THE DRAWINGS

The invention will in the following be described in more detail with reference to the enclosed drawings, wherein.

DETAILED DESCRIPTION OF EMBODIMENTS

Figure 1:
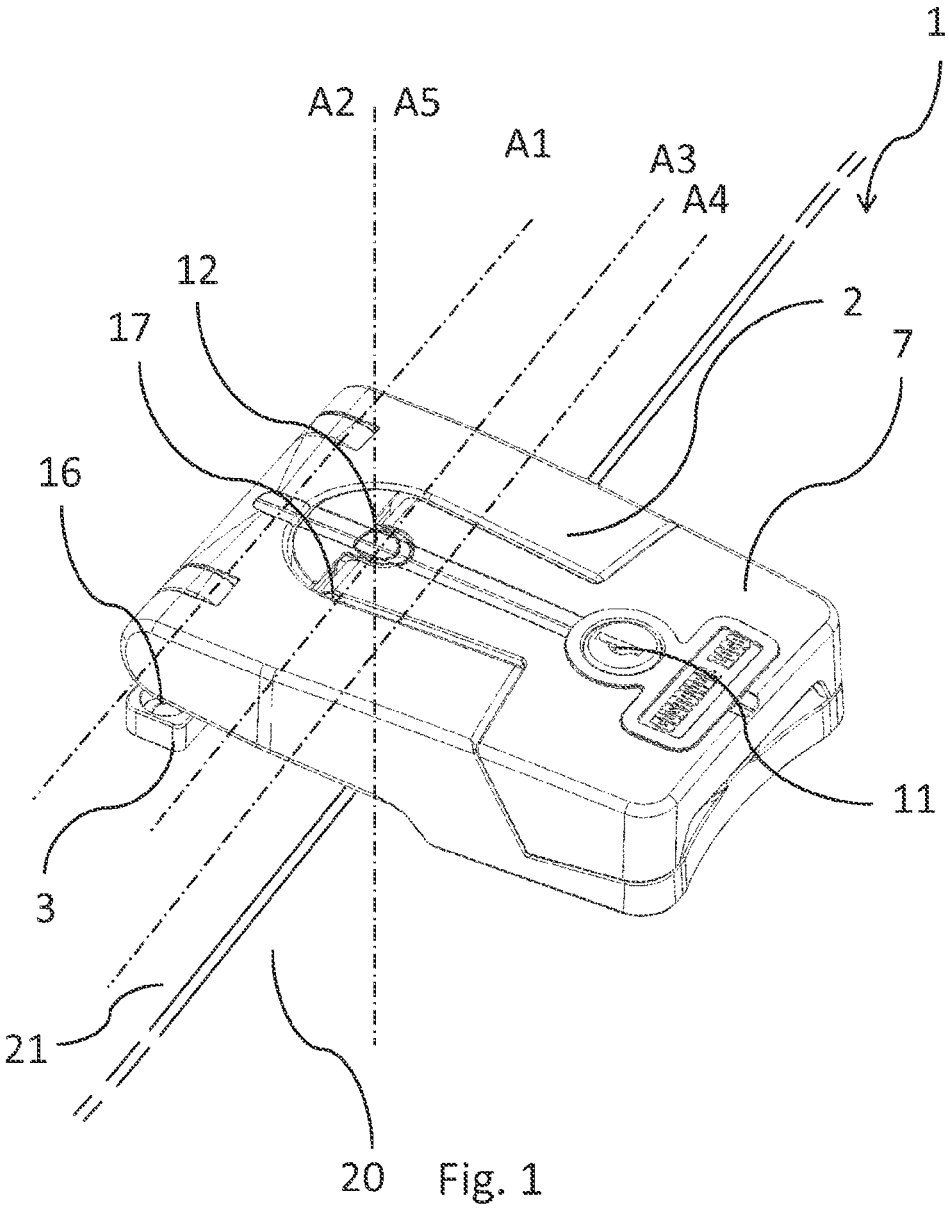
FIG. 1 is a perspective view of a disassemblable hinge according to an embodiment of the invention.

The present invention will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, like numbers refer to like elements.

In FIG. 1, a schematic view of a closed disassemblable hinge 1 is shown. The disassemblable hinge 1 has a latching member 2 and a hinge member 3. The latching member 2 has a main body 4, which is provided with a number of mounting holes 15 at the base for mounting on a door 20 or a hatch 20. The hinge member 3 is provided with a number of mounting holes 16 for mounting on a corresponding door frame 21 or similar. At the top side of the latching member, there is a handle 7. The handle 7 in FIG. 1 is in a folded down position which means that the disassemblable hinge 1 is closed and the handle inoperable. The handle is connected to a shaft 12 via a hinged connection 17. The shaft is connected to a pawl 22 (see FIG. 2). The lock comprises a keyed lock 11 in order to secure the handle 7 in a folded down position.

Figure 2:
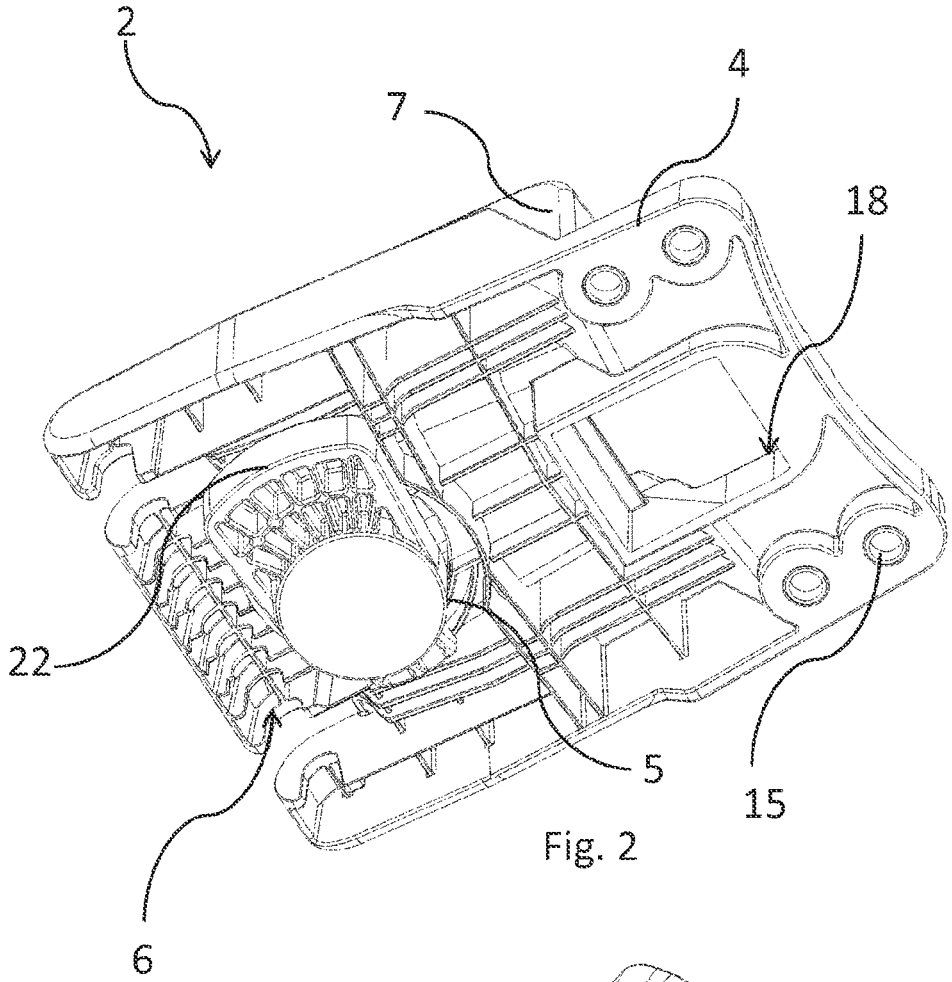
FIG. 2 is a perspective view of a latching member according to an embodiment of the invention.
Figure 3:
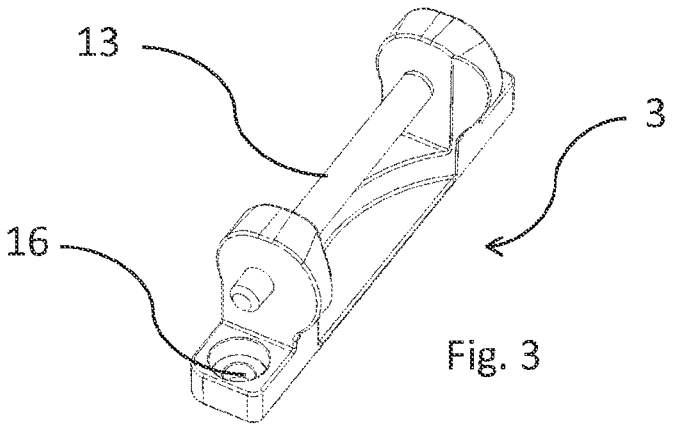
FIG. 3 is a perspective view of a hinge member according to an embodiment of the invention.

In FIG. 2, the latching member 2 is shown having a hinge slot 6, which runs across the latching member 2 and is adapted to receive the hinge member 3. The latching member 2 comprises a catch 5, which comprises a pawl 22. The catch 5 also comprises a shaft, seen in FIG. 1, which is connected to the handle 7 and thereby may be operated by the handle 7. As seen in FIG. 3, the hinge member 3 is provided with a hinge pin 13 which is adapted to be received in a corresponding hinge slot 6 on the latching member 2 to allow for a rotatable connection between the hinge member 3 and the latching member 2, which defines a first rotational axis A1. The hinge pin 13 may be circular cylindrical in shape, and the hinge slot may also have the corresponding shape, to allow for a rotational movement between the hinge slot 6 and the hinge pin 13. Since the hinge member 3 and the latching member 2 may be two separate parts, the hinge member 3 may be arranged so that the hinge pin 13 may be arranged in the hinge slot with low friction. The hinge member 3 may thereby swing freely relative to the latching member 2 when secured in the hinge slot 6.

Figure 4:
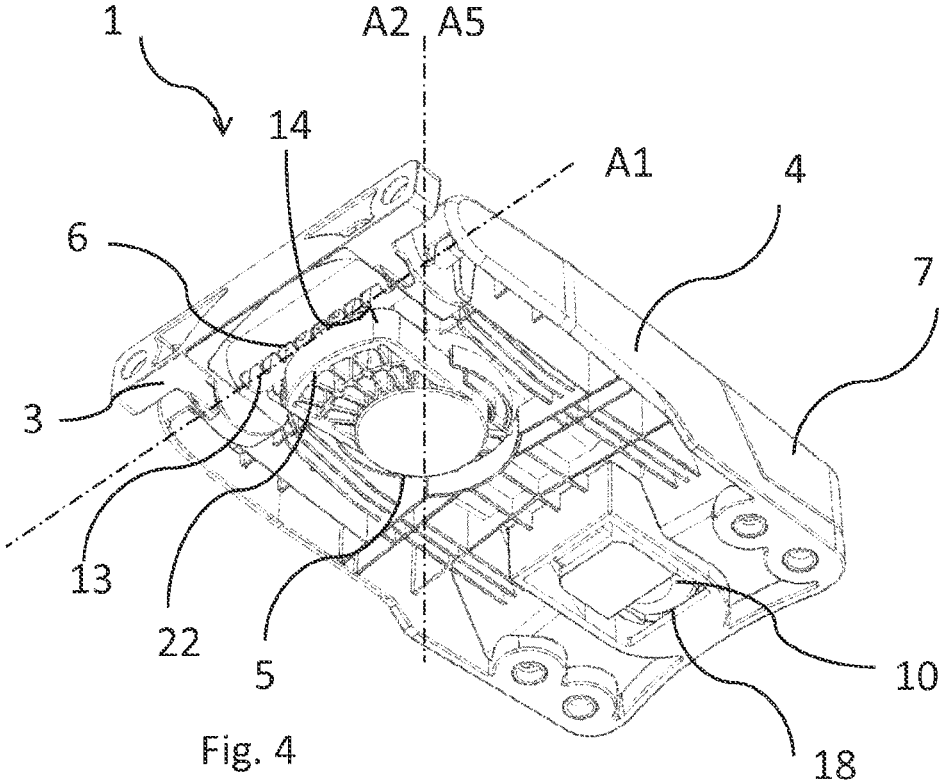
FIG. 4 is a perspective view of a disassemblable hinge in a closed state according to an embodiment of the invention.
Figure 5:
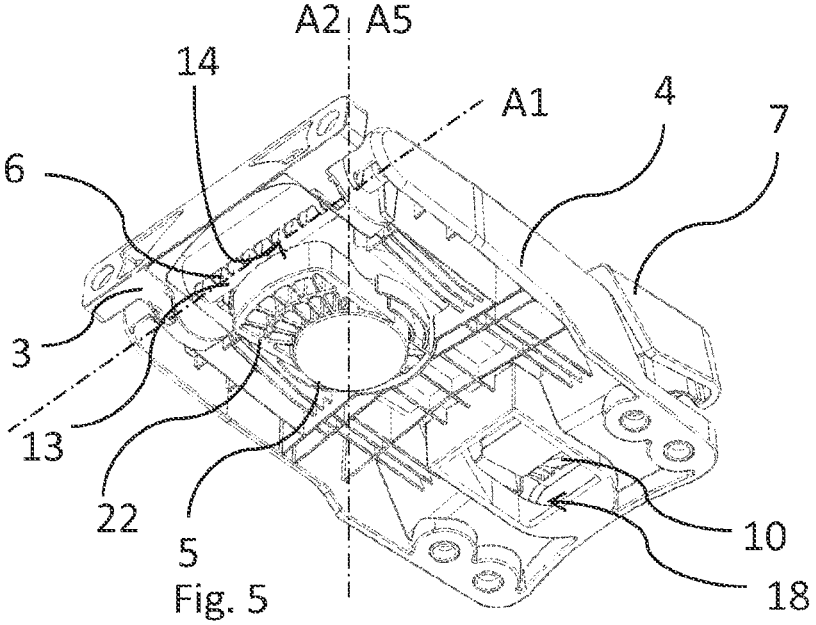
FIG. 5 is a perspective view showing the bottom of a disassemblable hinge in a disengaged state according to an embodiment of the invention.
Figure 6:
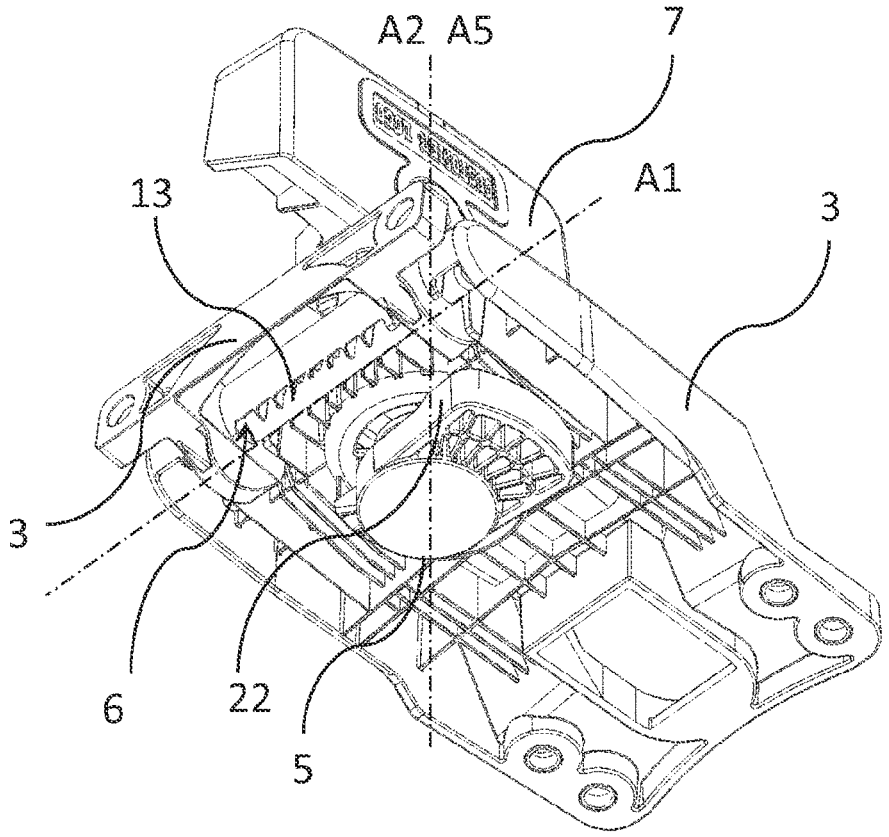
FIG. 6 is a perspective view showing the bottom of a disassemblable hinge in an open state according to an embodiment of the invention.

The disassemblable hinge 1 may be operated into at least three states: closed, disengaged and open. In FIGS. 4, 5 and 6, the three states are visually displayed. FIG. 4 shows a disassemblable hinge 1 in a closed state, in which state the disassemblable hinge 1 functions as a hinge between the door and door frame on which the latching member 2 and the hinge member 3 may be arranged. As seen, the pawl 22 is pressing against the hinge pin 13, which sits locked between the hinge slot 6 and the pawl in a space 14, and the handle 7 is in a folded down position. In the closed state, the hinge pin 13 is locked in the hinge slot 6. There may be a slight clearance between the hinge pin 13 and the hinge slot 6 to allow the hinge member 3 and the latching member 2 to swing relative to each other around a first rotational axis A1, which may be defined by the hinge slot 6 and the hinge pin 13. However, the size of the clearance may be adapted to the particular use of the disassemblable hinge, and may be tight enough to provide an air tight closure of the hatch. Alternatively, the hinge slot 6 may apply a tight fit to the hinge pin 13, but then the mounting of the hinge pin 13 in the hinge member may allow for rotation. Further in FIG. 4, it is also shown that the disassemblable hinge comprises a lock 10. The lock 10 is engaged to prevent the disassemblable hinge to accidentally open. The lock 10 on the underside of the latching member 2 is placed on the handle 7 and has a corresponding slot 18 located on the main body 4. The lock 10 and slot 18 is arranged so that when the handle is being forced into a folded down position, the lock 10 connects with the slot 18 and locks the handle 7 in its folded down position. The lock 10 may be operated with a keyed lock, as seen in FIG. 1, but can also be operated by any other manual mechanical arrangement, such as a twisting, pressing, sliding, pushing or pulling arrangement. The lock 10 may also be operated with a motor. The lock 10 may also be of any other arrangement such as a clasp, hasp, pin or clip, in order to prevent the handle 7 from accidentally lift from its folded down position.

In FIG. 5, the disassemblable hinge 1 is shown in a disengaged state. As seen, the lock 10 is released from the slot 18 and the handle 7 is raised. In response to the handle 7 moving from a folded down position to a raised position, the pawl 22 is moved relative to the hinge pin 13 axially along the second axis A2, expanding the space 14 that is limited by the hinge slot 6 and the pawl 22, allowing the hinge pin 13 to move relative to the latching member 2. However, the space 14 is expanded slightly, but not enough for the hinge pin 13 to escape from the grip by the pawl 22. The hinge pin 13 is hence still locked between the pawl 22 and the hinge slot 6. The handle may be raised to a near upright position, in which the handle 7 can be rotated relative to the main body 4 around a fifth axis A5.

FIG. 6 shows the disassemblable hinge in an open state. In the open state, the handle 7 has been raised fully, and rotated around the axis A5 in order to operate the pawl 22 into rotating out of the disengaged state into the open state. The handle 7 has been rotated approximately 90 degrees to move the pawl 22 to the open state. The pawl 22 is then removed from the hinge pin 13 and the hinge pin 13 may be released from the space 14, and subsequently the hatch may be opened by separating the latching member 2 and the hinge member 3. In order to close the hatch, a reverse manoeuvre is done by first placing the hinge pin 13 in the hinge slot, then rotating the pawl 22 into the disengaged state by operating the handle 7, see FIG. 5. The pawl 22 is then again locking the hinge pin 13 in the space 14. Subsequently, the handle 7 can be lowered, causing the pawl to compress against the hinge pin 13 and thereby narrowing the space 14, see FIG. 4. The pawl may cause a compression on the hinge pin 13 by allowing the pawl 22 to move axially along the second axis A2 towards the hinge pin.

Figure 7:
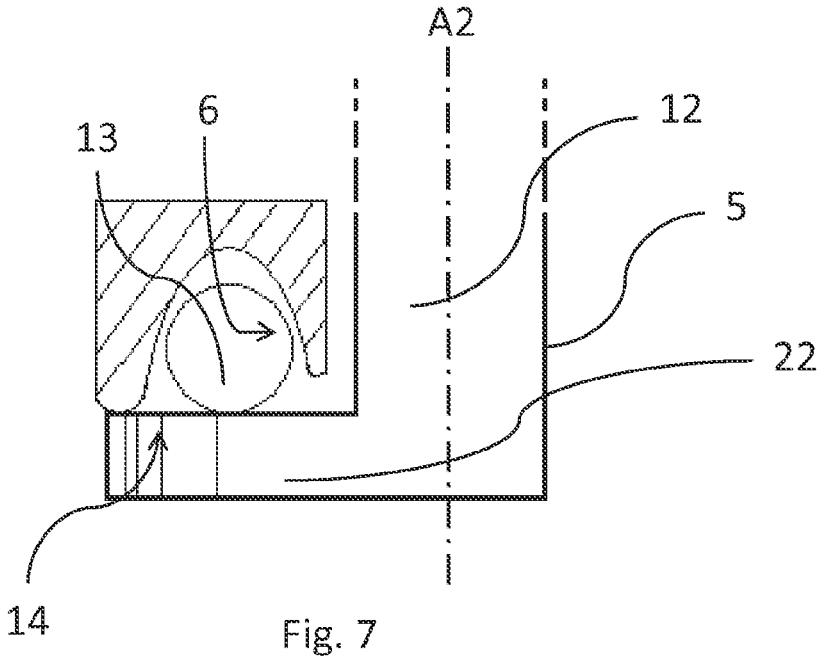
FIG. 7 is a schematic cross sectional view of a disassemblable hinge in a closed state according to an embodiment of the invention.
Figure 8:
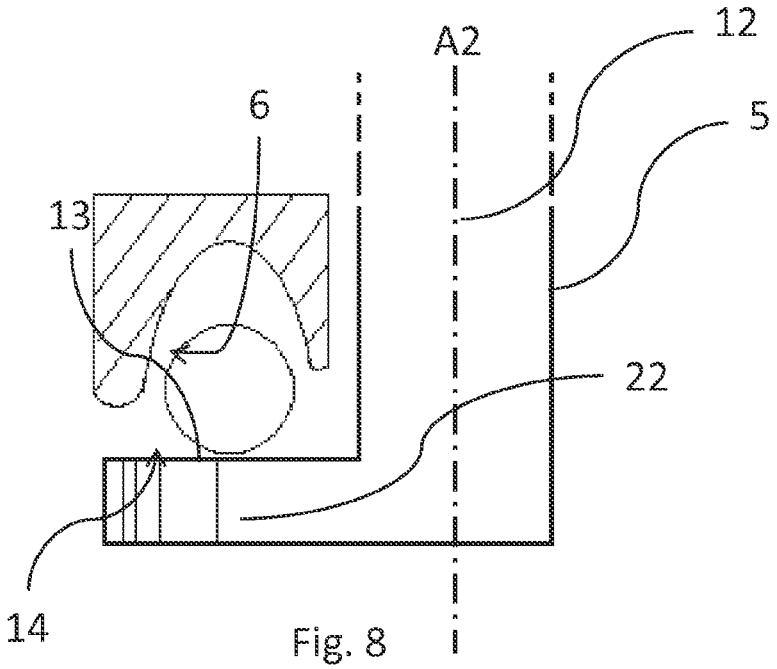
FIG. 8 is a schematic cross sectional view of a disassemblable hinge in a disengaged state according to an embodiment of the invention.

In order to create the pawl's 22 axial movement as a response to lowering the handle 7, a momentum is produced by the handle 7 to act upon the pawl via a shaft 12. FIG. 7 and FIG. 8 show schematically the movement of the pawl 22 relative to the hinge pin 13. As seen in FIG. 7, the pawl 22 is in the closed state, pressing against the hinge pin 13, creating a space 14 limited by the pawl 22 and the hinge slot 6. The hinge pin 13 is thereby locked in the space 14, and a hinge function between the latching member 2 and the hinge member 3 is provided. In FIG. 8, the pawl is in the disengaged state, having expanded the space 14 between the pawl 22 and the hinge slot 6. By expanding the space, the hatch may be partially opened, possibly to equalise any pressure that may have been trapped behind the hatch, for instance if the hatch is a service hatch in a pressurised ventilation duct. Having the pressure equalised before complete opening of the hatch may secure the hatch from flinging open by accident onto the maintenance staff. The hinge pin 13 is however still locked inside the space 14, preventing the hatch from being fully opened.

Figure 9:
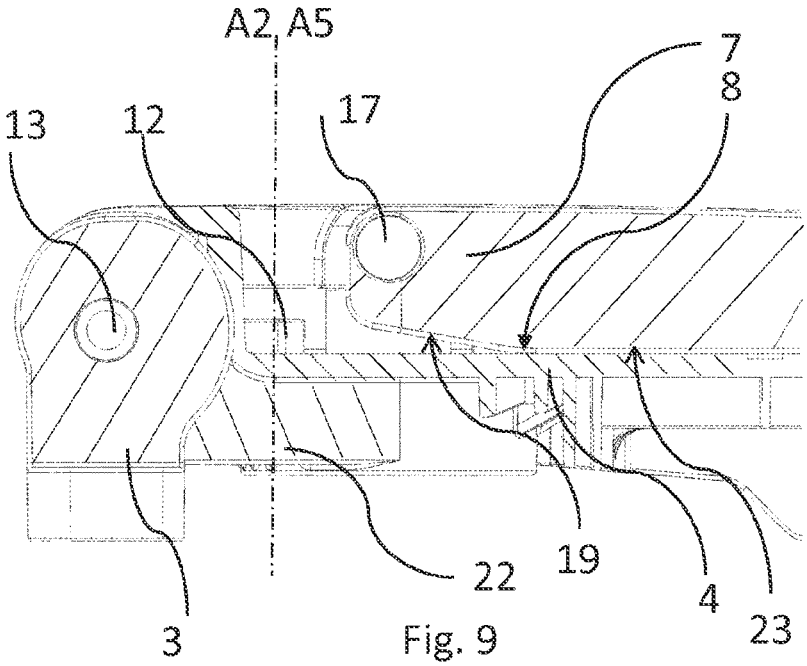
FIG. 9 is a schematic cross sectional view of the pawl and the hinge pin in a closed state according to an embodiment of the invention.
Figure 10:
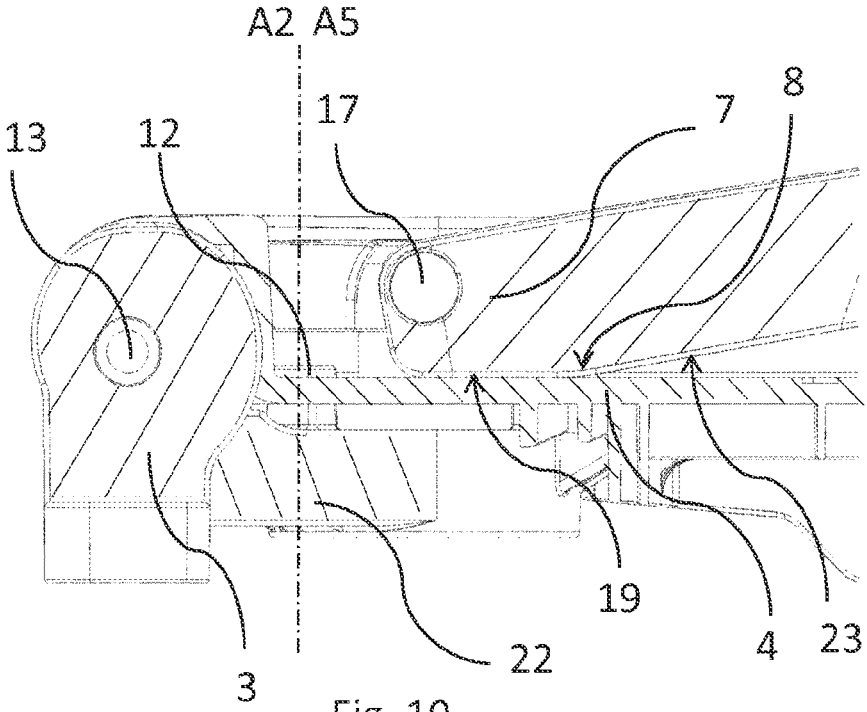
FIG. 10 is a schematic cross sectional view of the pawl and the hinge pin in a disengaged state according to an embodiment of the invention.

FIG. 9 and FIG. 10 shows a cross section of the disassemblable hinge from the side, showing the shape of the handle 7 that may allow for the handle 7 to produce a momentum. As seen, the handle 7 is provided with a chamfered edge 19, a flat edge 23 and a seal 8, which function to create a momentum around a momentum axis A4, when tilted relative to the main body 4. When the handle 7 is in a slightly raised position, as seen in FIG. 10, the handle 7 leans on a chamfered edge 19 on the handle 7. As the handle 7 is lowered towards the main body 4, the chamfered edge 19 is pressed against the flat surface of the main body 4. As the handle is further lowered, as seen in FIG. 9, the transition from the chamfered edge 19 via the seat 8 to a flat edge 23 on the handle will cause leverage and produce momentum on the pawl 22. This momentum may force the pawl 22 to move in the opposite direction axially along the second axis A2, in the extension of the pawl 22 due to the counter force resulting from the momentum. This is possible due to the connection between the catch 5 and the handle 7. The pawl 22 will as a result press against the hinge pin 13. The rotational movement of the handle 7 around the third axis A3 may thus produce the axial movement of the pawl by the pawl responding to the momentum acting around the momentum axis A4. Also, by allowing the seat 8 to slide freely relative to the main body, it prevents any tension forces to arise in the shaft. By pressing the pawl against the hinge pin, it provides a compression function that may secure the hatch to be air tight, which may be crucial if the hatch is mounted on a ventilation duct. It is possible that the seat is incorporated in the main body 4 as a support or a pin, extruding from the main body 4.

Figure 11:
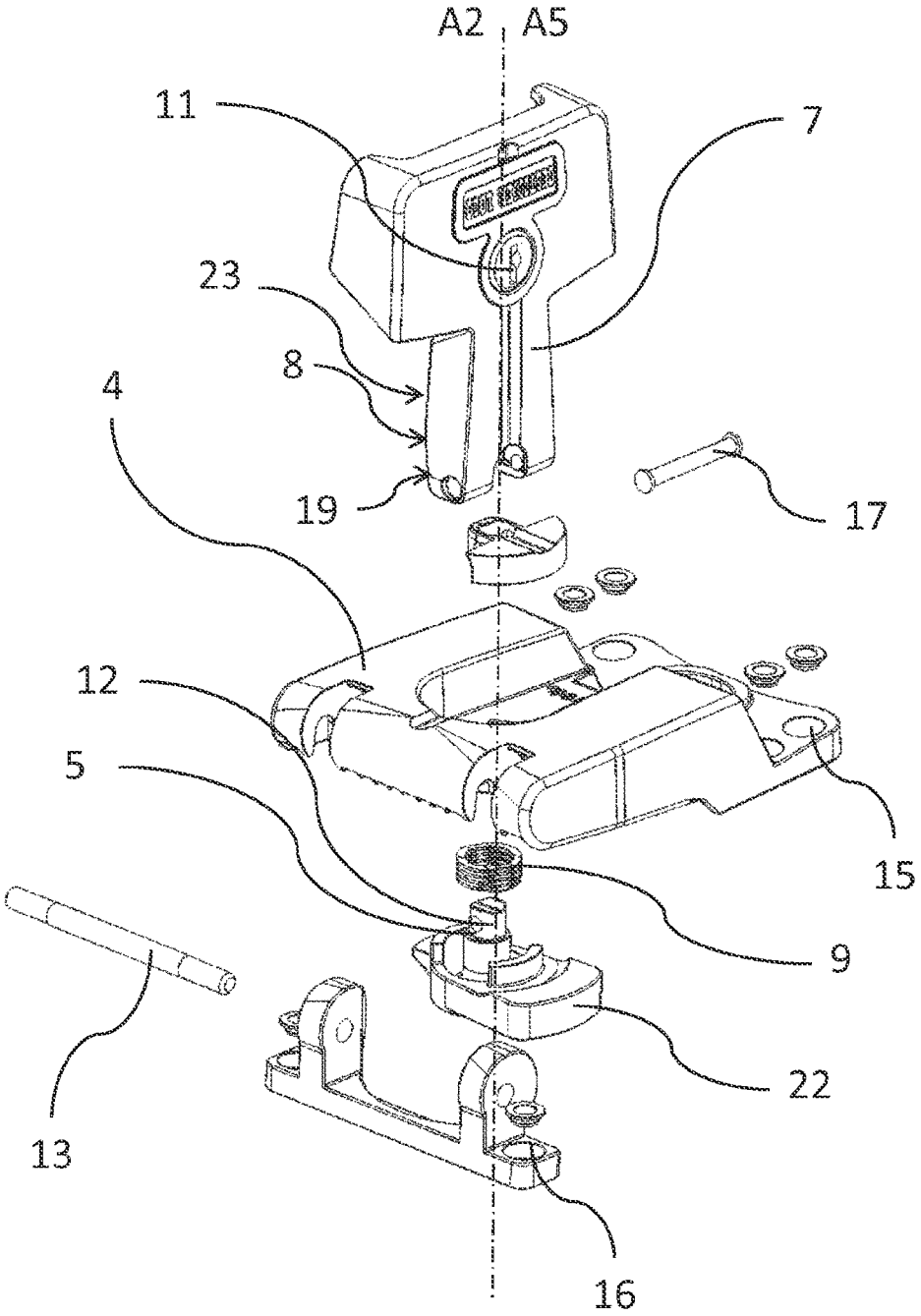
FIG. 11 is en exploded view of a disassemblable hinge according to an embodiment of the invention.

In FIG. 11, the disassemblable hinge 1 is seen in an exploded view. The handle is connected to the pawl 22 via a shaft 12 which is extending along a second axis A2. The pawl 22 is movable to correspond to the movement of the handle 7, such that when the handle 7 is turned around the fifth axis A5, the pawl 22 will turn. Further, the handle is connected to the shaft 12 via a hinged joint 17, which defines the third axis A3, as seen in FIG. 1. The shaft 12 may be separate or incorporated with the pawl 22. As seen in FIG. 2, the handle 7 is rotatable around a fifth axis A5. In FIG. 2, the fifth axis A5 coincides with the second axis A2. However, the fifth axis A5 may be located at a distance from the second axis A2 if there may be a need. For instance, if the distance between the handle and the shaft is big, the second axis A2 and the fifth axis A5 may be located further apart, having spurred or cogged wheels to transfer the rotation of the handle 7 to the pawl 22.

Near the shaft, a coil spring 9 is arranged. The coil spring 9 may be provided in order to act with a spring force upon the pawl 22 when the pawl 22 is in its dosed state. As the pawl 22 is in its dosed state, the spring 9 may be tensioned. When the lock 10 is released, the spring force of the spring 9 may act on the pawl 22 to force it to move axially along the second axis A2 into the disengaged state. Further in FIG. 11, is seen a number of mounting holes 15, 16 which are provided in order to fasten the hinge member 3 onto a door frame 2 (not shown) and the latching member 2 onto a door 20.

Figure 12:
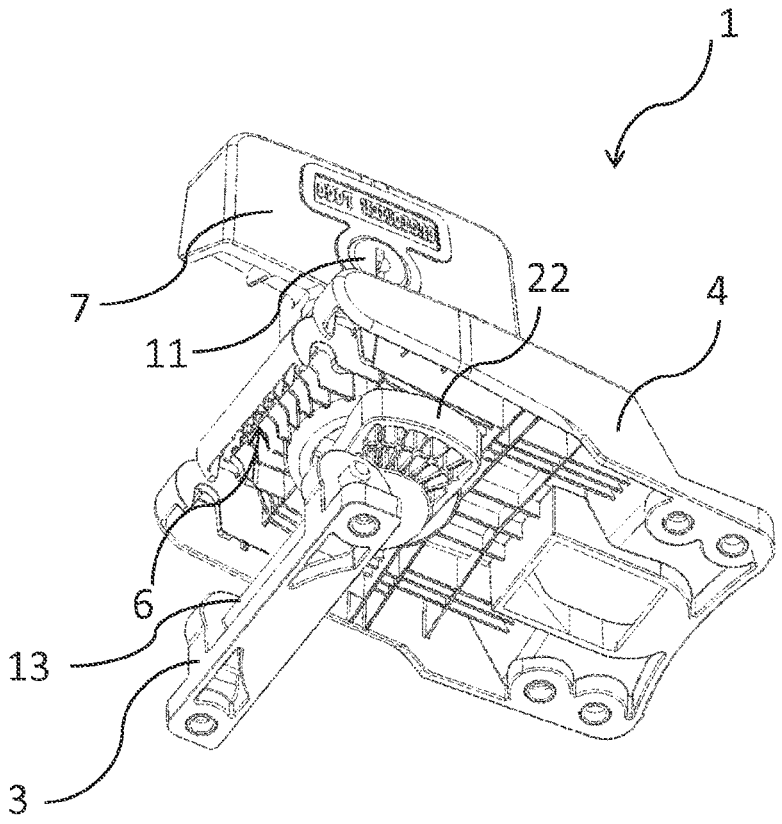
FIG. 12 is a perspective view of an opened and disconnected disassemblable hinge according to an embodiment of the invention.

FIG. 12 shows a disassemblable hinge in a fully open state wherein the hinge member 3 and the latching member 2 are completely separated.

The invention claimed is:

1. A disassemblable hinge having a latching member, adapted to be associated with an openable door, and a hinge member, adapted to be associated with a corresponding door frame, wherein said latching member comprises:

a main body and a catch, wherein said main body comprises a hinge slot adapted to receive said hinge member, and wherein said hinge member comprises a hinge pin, adapted to be received in said hinge slot, wherein said catch is rotatably engageable with said hinge member around a first axis, wherein said catch is movable between a closed state and an open state, said catch further is movable into a disengaged state, wherein said catch and said hinge slot defines a space for housing said hinge member, wherein said catch, in its closed state, locks said hinge member in said space, wherein said space is expanded when said catch is moved from said closed state to said disengaged state, wherein said catch is moved from said disengaged state to said open state by rotating said catch around a second axis, thereby releasing said hinge member from said space wherein said catch is moved from said closed state to said disengaged state by moving said catch away from said hinge member axially along the second axis, and wherein said second axis is perpendicular to said first axis, and wherein said catch comprises a shaft and a pawl, said shaft extending axially along said second axis, wherein said pawl is perpendicular to said shaft.

2. A disassemblable hinge according to claim 1, wherein said latching member further comprises a handle which is pivotal relative to said main body, wherein said catch is connected to said handle.

3. A disassemblable hinge according to claim 2, wherein said handle is rotatably connected to said catch about a third axis.

4. A disassemblable hinge according to claim 2, wherein said handle is adapted to produce a momentum around a momentum axis, when said handle is moved between a folded down position and a raised position, that causes said catch to move axially along said second axis.

5. A disassemblable hinge according to claim 4, wherein said momentum axis is located at a distance from said second axis.

6. A disassemblable hinge according to claim 4, wherein said momentum axis is defined by a seat that causes said handle to act as a lever arm on said catch.

7. A disassemblable hinge according to claim 3, wherein said handle is rotatable around a fifth axis, whereby said catch is moved between said disengaged state and said open state when said handle is rotated.

8. A disassemblable hinge according to claim 7, wherein said fifth axis coincides with said second axis.

9. A disassemblable hinge according to claim 2, wherein said latching member further comprises a lock, arranged to prevent said catch to move from its closed state.

10. A disassemblable hinge according to claim 9, wherein said lock is arranged on said handle in order to lock said handle to the main body when said handle is moved to a folded down position.

11. A disassemblable hinge according to claim 9, wherein said lock is operated by a keyed lock.

12. A disassemblable hinge according to claim 1, wherein said latching member further comprises a spring member, arranged to act with a spring force upon said catch.

13. A disassemblable hinge according to claim 12, wherein said spring member is arranged adjacent to said shaft, wherein said spring member is compressed when said catch is in its closed state.

14. A disassemblable hinge according to claim 12, wherein said spring member is a coil spring.

15. A disassemblable hinge having a latching member, adapted to be associated with an openable door, and a hinge member, adapted to be associated with a corresponding door frame, wherein said latching member comprises a main body and a catch, wherein said main body comprises a hinge slot adapted to receive said hinge member, and wherein said hinge member comprises a hinge pin, adapted to be received in said hinge slot, wherein said catch is rotatably engageable with said hinge member around a first axis, wherein said catch is movable between a closed state and an open state, said catch further is movable into a disengaged state, wherein said catch and said hinge slot defines a space for housing said hinge member, wherein said catch, in its closed state, locks said hinge member in said space, wherein said space is expanded when said catch is moved from said closed state to said disengaged state, wherein said catch is moved from said disengaged state to said open state by rotating said catch around a second axis, thereby releasing said hinge member from said space wherein said catch is moved from said closed state to said disengaged state by moving said catch away from said hinge member axially along the second axis, and wherein said second axis is perpendicular to said first axis and wherein said catch comprises a shaft and a pawl, said shaft extending axially along said second axis, wherein said pawl is perpendicular to said shaft, and wherein said latching member further comprises a handle which is pivotal relative to said main body, wherein said catch is connected to said handle, and wherein said handle is rotatably connected to said catch by a third axis.

16. A disassemblable hinge having a latching member, adapted to be associated with an openable door, and a hinge member, adapted to be associated with a corresponding door frame, wherein said latching member comprises a main body and a catch, wherein said main body comprises a hinge slot adapted to receive said hinge member, and wherein said hinge member comprises a hinge pin, adapted to be received in said hinge slot, wherein said catch is rotatably engageable with said hinge member around a first axis, wherein said catch is movable between a closed state and an open state, said catch further is movable into a disengaged state, wherein said catch and said hinge slot defines a space for housing said hinge member, wherein said catch, in its closed state, locks said hinge member in said space, wherein said space is expanded when said catch is moved from said closed state to said disengaged state, wherein said catch is moved from said disengaged state to said open state by rotating said catch around a second axis, thereby releasing said hinge member from said space wherein said catch is moved from said closed state to said disengaged state by moving said catch away from said hinge member axially along the second axis, and wherein said second axis is perpendicular to said first axis and wherein said catch comprises a shaft and a pawl, said shaft extending axially along said second axis, wherein said pawl is perpendicular to said shaft and, wherein said latching member further comprises a spring member, arranged to act with a spring force upon said catch, and wherein said spring member (9) is a coil spring.

* * * * *